US009968806B2

(12) United States Patent
Langford et al.

(10) Patent No.: US 9,968,806 B2
(45) **Date of Patent: *May 15, 2018**

(54) CARRYING PLATE FOR BREATHING APPARATUS

(71) Applicant: Scott Health & Safety Ltd., Lancashire (GB)

(72) Inventors: Graham Langford, Merseyside (GB); John Patrick Kearns, Liverpool (GB); Robert C. Sutton, Merseyside (GB)

(73) Assignee: Scott Health & Safety Ltd., Lancashire (GB)

( * ) Notice: Subject to any disclaimer, the term of this patent is extended or adjusted under 35 U.S.C. 154(b) by 86 days.

This patent is subject to a terminal disclaimer.

(21) Appl. No.: 15/139,535

(22) Filed: Apr. 27, 2016

(65) Prior Publication Data

US 2016/0236015 A1 Aug. 18, 2016

Related U.S. Application Data

(63) Continuation of application No. 14/509,684, filed on Oct. 8, 2014, now Pat. No. 9,604,080, which is a (Continued)

(30) Foreign Application Priority Data

Sep. 27, 2013 (GB) ..... 1317249.9

(51) Int. Cl.
*A62B 9/04* (2006.01)
*A45F 3/10* (2006.01)

(Continued)

(52) U.S. Cl.
CPC ..... *A62B 9/04* (2013.01); *A45F 3/10* (2013.01); *A62B 9/02* (2013.01); *A62B 25/00* (2013.01);

(Continued)

(58) Field of Classification Search
CPC .. A62B 9/04; A62B 25/00; A62B 9/02; B63C 2011/026; A45F 3/10;

(Continued)

(56) References Cited

U.S. PATENT DOCUMENTS 4,016,616 A * 4/1977 Walters ..... B63C 11/2245 114/315
4,497,069 A 2/1985 Braunhut (Continued)

FOREIGN PATENT DOCUMENTS

DE 29704328 U 5/1997
WO 97/48302 12/1997

(Continued)

OTHER PUBLICATIONS

Notification of Transmittal of the International Search Report and the Written Opinion on the International Searching Authority for Application No. PCT/GB2014/052915, dated Feb. 23, 2015 (11 pages).

*Primary Examiner* — Scott McNurlen
(74) *Attorney, Agent, or Firm* — Dean D. Small; The Small Patent Law Group, LLC

(57) ABSTRACT

A mounting assembly for a self-contained breathing apparatus (SCBA) includes a back plate defining a plurality of apertures therethrough arranged in first and second columns. The apertures in the columns are sized and spaced to receive corresponding first and second mounting straps woven therethrough that are configured to extend around webbing straps of a carrying jacket to fasten the back plate to the carrying jacket. The back plate includes a first press stud associated with the first column and a second press stud associated with the second column, which are configured to engage ends of the respective first and second mounting straps to releasably secure the mounting straps to the back plate. A tank securing strap on the back plate releasably (Continued)

fastens a supply tank to the back plate. A valve retaining mount on the back plate releasably secures an air supply valve for engagement with the supply tank.

20 Claims, 4 Drawing Sheets

Related U.S. Application Data continuation of application No. PCT/GB2014/052915, filed on Sep. 26, 2014.

(51) Int. Cl.
*A62B 9/02* (2006.01)
*A62B 25/00* (2006.01)
*A45F 3/14* (2006.01)

(52) U.S. Cl.
CPC ..... *A45F 2003/146* (2013.01); *A45F 2200/00* (2013.01); *A45F 2200/0566* (2013.01)

(58) Field of Classification Search
CPC .. A45F 3/14–2003/146; A45F 2200/00; A45F 2200/0566; A45F 3/06; A45F 2003/003
USPC ..... 224/628, 633, 907, 934, 261, 582–583, 224/255, 673–675, 901–901.8, 259, 224/262–264
See application file for complete search history.

(56) References Cited

U.S. PATENT DOCUMENTS 4,620,653 A 11/1986 Farrell
4,979,657 A 12/1990 Espiritu
6,186,521 B1 2/2001 Divoky et al.
D468,792 S 1/2003 Jacoway et al.
6,926,243 B1 * 8/2005 Ziaylek ..... A62B 25/00 248/307
7,490,358 B1 * 2/2009 Beck ..... A41D 13/0531 2/102
8,496,149 B1 * 7/2013 Sohm ..... A45F 3/10 224/153
8,517,636 B2 * 8/2013 Wrigley ..... A45F 3/14 224/934
8,608,040 B2 * 12/2013 Cheesman ..... A62B 25/00 224/628
8,695,171 B2 * 4/2014 Colorado ..... A45F 3/10 224/675
2002/0078959 A1 * 6/2002 Haeuser ..... A62B 9/04 128/205.22
2004/0082238 A1 4/2004 Jacoway et al.
2005/0098597 A1 5/2005 Cottrell et al.
2009/0229603 A1 * 9/2009 Grilliot ..... A41D 13/0007 128/202.19
2010/0282252 A1 11/2010 Cheesman et al.
2011/0048421 A1 * 3/2011 Carr ..... A45F 3/10 128/205.22
2011/0191933 A1 * 8/2011 Gregory ..... A41D 13/0012 2/69
2014/0091124 A1 * 4/2014 Hexels ..... A45F 3/08 224/663
2015/0090751 A1 4/2015 Langford et al.

FOREIGN PATENT DOCUMENTS

WO WO 2008/131241 10/2008
WO 2014/096797 6/2014

* cited by examiner

CARRYING PLATE FOR BREATHING APPARATUS

CROSS-REFERENCE TO RELATED APPLICATIONS

The present application is a continuation of U.S. patent application Ser. No. 14/509,684 (the "'684 application"), which was filed Oct. 8, 2014 and is incorporated by reference in its entirety. The '684 application claims priority to International Application No. PCT/GB2014/052915 (the "'915 application"), filed Sep. 26, 2014, which claims priority to Great Britain Patent Application No. GB 1317249.9 (the "'249 application"), filed Sep. 27, 2013. Both the '915 application and the '249 application are hereby incorporated by reference in their entirety.

BACKGROUND OF THE INVENTION

The subject matter described and/or illustrated herein relates generally to harness plates for carrying breathing apparatuses, such as air tanks and associated equipment.

Self-contained breathing apparatuses (SCBA) are used in a variety of situations where an individual and safe supply of breathable air is required by a user, such as by firefighters entering a smoke filled environment. The equipment includes an air tank, which stores breathable air under pressure, and a regulator valve, which delivers the air to the mouth of the user at a pressure suitable for the user to breath.

Typically, the air tank is large to enable it to hold at least enough air for the user to complete a required task. Due to the large size, the air tank is normally carried on the back of the user. For this purpose, a carrying assembly is coupled to the tank. The carrying assembly includes a rigid plate with a restraining strap that wraps around the air tank to secure the air tank to the plate, typically with the air tank in an outlet down position. The plate also has apertures formed therein. Shoulder and waist harness straps are threaded through the apertures to allow the plate to be carried on the back of the user. The plate and/or harness straps normally include suitable features that enable tubing associated with the SCBA to be routed around and retained in place on the carrying assembly.

Known carrying assemblies may be time consuming to don and remove, which can be a significant issue in certain situations. Furthermore, the shoulder and waist straps may extend tightly around the user, which may restrict both the movement of the user and also the user's accessibility to other equipment on the user's person. Furthermore, in military and civil defence industries, certain specialist users require the use of SCBA while wearing body armour and/op bulletproof vest-type jackets. Many current SCBA's are designed for the firefighting industry and do not integrate very well with other types of body worn equipment in other industries.

A need remains for an SCBA harness mounting system which is better applicable for use in specialist applications than known SCBA harness mounting systems. A need also remains for a mounting assembly which can integrate directly with existing webbing and body armour used in specialist applications.

BRIEF DESCRIPTION OF THE INVENTION

In an embodiment, a mounting assembly for a self-contained breathing apparatus (SCBA) is provided that includes a back plate, a tank securing strap, and a valve retaining mount. The back plate includes an inner side and an opposite outer side and extends between a top and a bottom. The back plate defines a plurality of apertures extending therethrough between the inner side and the outer side. The apertures are arranged in a first column and a second column extending generally parallel to each other. The apertures in the first and second columns are sized and spaced to receive corresponding first and second mounting straps woven therethrough such that the first mounting strap is woven through the first column and the second mounting strap is woven through the second column. The first and second mounting straps are configured to extend around webbing straps of a carrying jacket of a user to fasten the back plate to the carrying jacket. The inner side of the back plate faces the carrying jacket when the back plate is fastened to the carrying jacket. The back plate further includes at least a first press stud associated with the first column and a second press stud associated with the second column. The first and second press studs are each configured to engage an end of the respective first and second mounting straps to releasably secure the first and second mounting straps to the back plate. The tank securing strap is fastened to the back plate and extends from the outer side of the back plate. The tank securing strap is configured to engage a supply tank to securely and releasably fasten the supply tank to the back plate. The valve retaining mount is disposed on the back plate along the outer side. The valve retaining mount is configured to releasably secure an air supply valve to the back plate for engagement with the supply tank.

In an embodiment, a mounting assembly for a self-contained breathing apparatus (SCBA) is provided that includes a back plate, first and second mounting straps, a tank securing strap, and a valve retaining mount. The back plate includes an inner side and an opposite outer side and extends between a top and a bottom. The back plate defines a plurality of apertures extending therethrough between the inner side and the outer side. The apertures are arranged in a first column and a second column extending generally parallel to each other. The back plate further includes a first press stud associated with the first column and a second press stud associated with the second column. The first mounting strap is woven through the apertures in the first column, and the second mounting strap is woven through the apertures in the second column. The first and second mounting straps are woven through the respective first and second columns such that each of the first and second mounting straps alternates between extending along the inner side of the back plate and extending along the outer side of the back plate. Portions of the first and second mounting straps extending along the inner side of the back plate are configured to extend around webbing straps of a carrying jacket of a user to fasten the back plate to the carrying jacket. An end of the first mounting strap couples to the first press stud to releasably secure the first mounting strap to the back plate, and an end of the second mounting strap couples to the second press stud to releasably secure the second mounting strap to the back plate. The tank securing strap is fastened to the back plate and extends from the outer side of the back plate. The tank securing strap is configured to engage a supply tank to securely and releasably fasten the supply tank to the back plate. The valve retaining mount is disposed on the back plate along the outer side. The valve retaining mount is configured to releasably secure an air supply valve to the back plate for engagement with the supply tank.

The mounting assembly in accordance with one or more embodiments has the advantage that the back plate is securable directly to a jacket normally worn by a user, such as a body armour jacket or the like. Therefore, the mounting assembly avoids the restrictions in movement and limited accessibility to equipment that are associated with known mounting assembly designs. Furthermore, due to the releasability of the tank securing strap and the valve retaining mount, the SCBA equipment (tank and valve assembly) may easily and quickly be dumped by the user, if circumstances necessitate, without having to remove or discard the jacket.

In an embodiment, the apertures in the back plate are configured to interface with and/or couple to the user's clothing using a method of MOLLE attachment (Modular Light Weight Load Carrying Equipment). MOLLE attachment uses an interlocking weave of vertical and horizontal webbing that secures one item to another. In an embodiment, each column of apertures has a fastening strap woven through the apertures of that column and secured at the top and bottom of the plate. Each of the straps may be configured to be engageable through horizontal MOLLE straps of the webbing so as to hang the back plate on the webbing.

In an embodiment, at least one of the top or the bottom of each of the straps, such as the bottom of the straps for example, is attached to the back plate by a quick release system, such as via press studs. In this way a wearer can easily jettison the back plate and any apparatus mounted thereon without third party assistance by simply releasing the attachment of the straps from the back plate and allowing the weight of the back plate and the apparatus mounted thereon to cause the straps to un-weave from the MOLLE straps.

In an embodiment, at least one of the tank securing strap and the valve retaining mount has a quick release mechanism or operation associated therewith. Thus, when the tank securing strap and/or the valve retaining mount are not required, the user can quickly and easily remove the valve and associated supply lines, as well as the tank, from the back plate, leaving the only back plate attached to the user's jacket or other clothing.

In an embodiment, the valve retaining mount provides a bayonet type coupling for fastening an air supply valve to the back plate. For example, the valve retaining mount may be a system that requires relative rotation of substantially 90 degrees between the air supply valve and the back plate in order for the valve to secure to and release from the back plate.

The back plate may be made of light weight material, such as carbon fibre or polymeric material, with a low profile. Fastened to the back plate are specialist mountings which allow pneumatics to be quickly mounted to the back plate, even for multiple tank sizes.

Pipe retainers may also be provided on the back plate. The pipe retainers are configured to retain and/or secure in place pipes, tubes, and/or hoses that are associated with a valve assembly in order to route the hoses from the air supply valve to a defined or designated location that is accessible to the user during operation.

BRIEF DESCRIPTION OF THE DRAWINGS

Reference is made to the accompanying drawings in which particular embodiments and further benefits of the inventive subject matter are illustrated as described in more detail in the description below, in which.

DETAILED DESCRIPTION OF THE INVENTION

Figure 1:
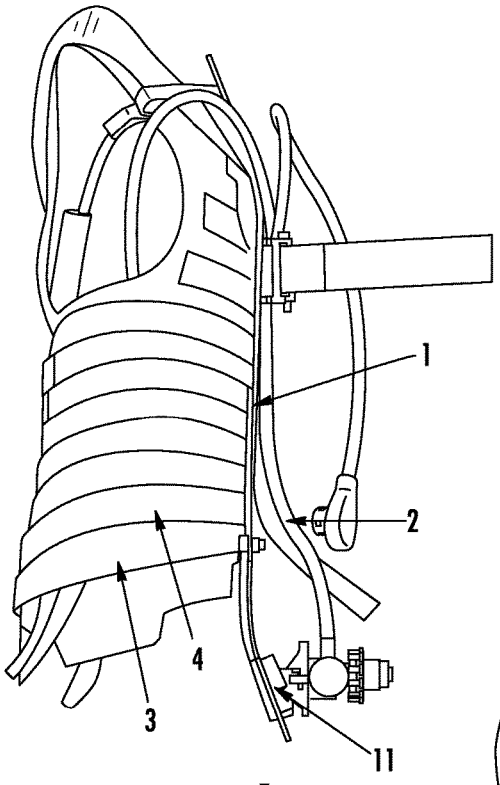
FIG. 1 is a side view of a bullet proof jacket with a mounting assembly formed in accordance with an embodiment.
Figure 2:
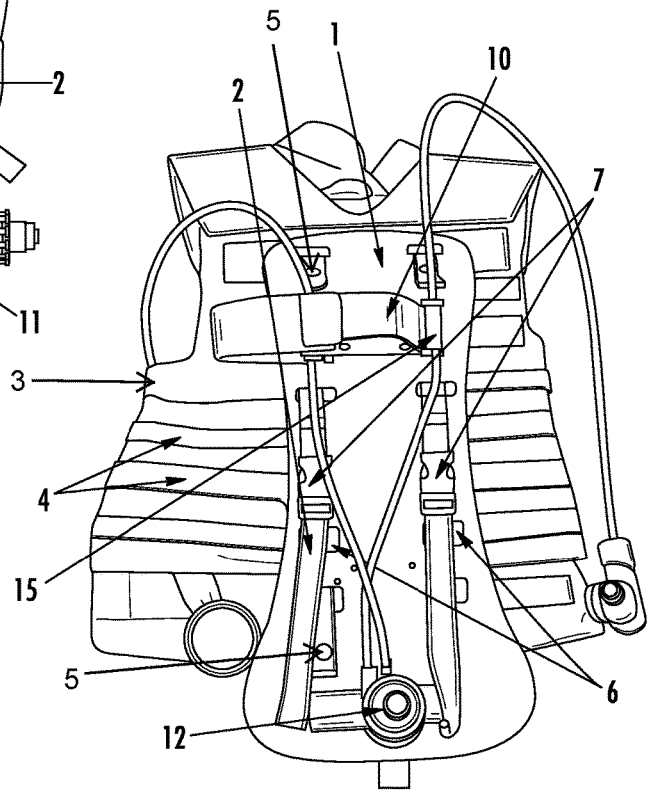
FIG. 2 is a back view of the jacket of FIG. 1.

FIG. 1 is a side view of a bullet proof jacket with a mounting assembly formed in accordance with an embodiment. The mounting assembly includes a back plate 1 mounted by MOLLE straps 2 to a body armour jacket 3. The jacket 3 has horizontal webbing straps 4 which extend around the jacket 3. The webbing straps 4 are fastened to the jacket 3 at aligned intervals, forming aligned points or gaps at which the MOLLE straps 2 may be fed vertically through the webbing straps 4 between each strap and the jacket 3. Referring now to FIG. 2, the MOLLE straps 2 are attached to the back plate 1 at the top and bottom by press studs 5. The press studs 5 enable the user to easily detach the top and/or bottom of each MOLLE strap 2 from the back plate 1 to release the back plate 1 and any equipment mounted thereon from the jacket 3 while wearing the jacket 3. Although press studs 5 are shown in FIG. 2, it is understood that other releasable fasteners for fastening the MOLLE straps 2 to the back plate 1 may be used.

Figure 3:
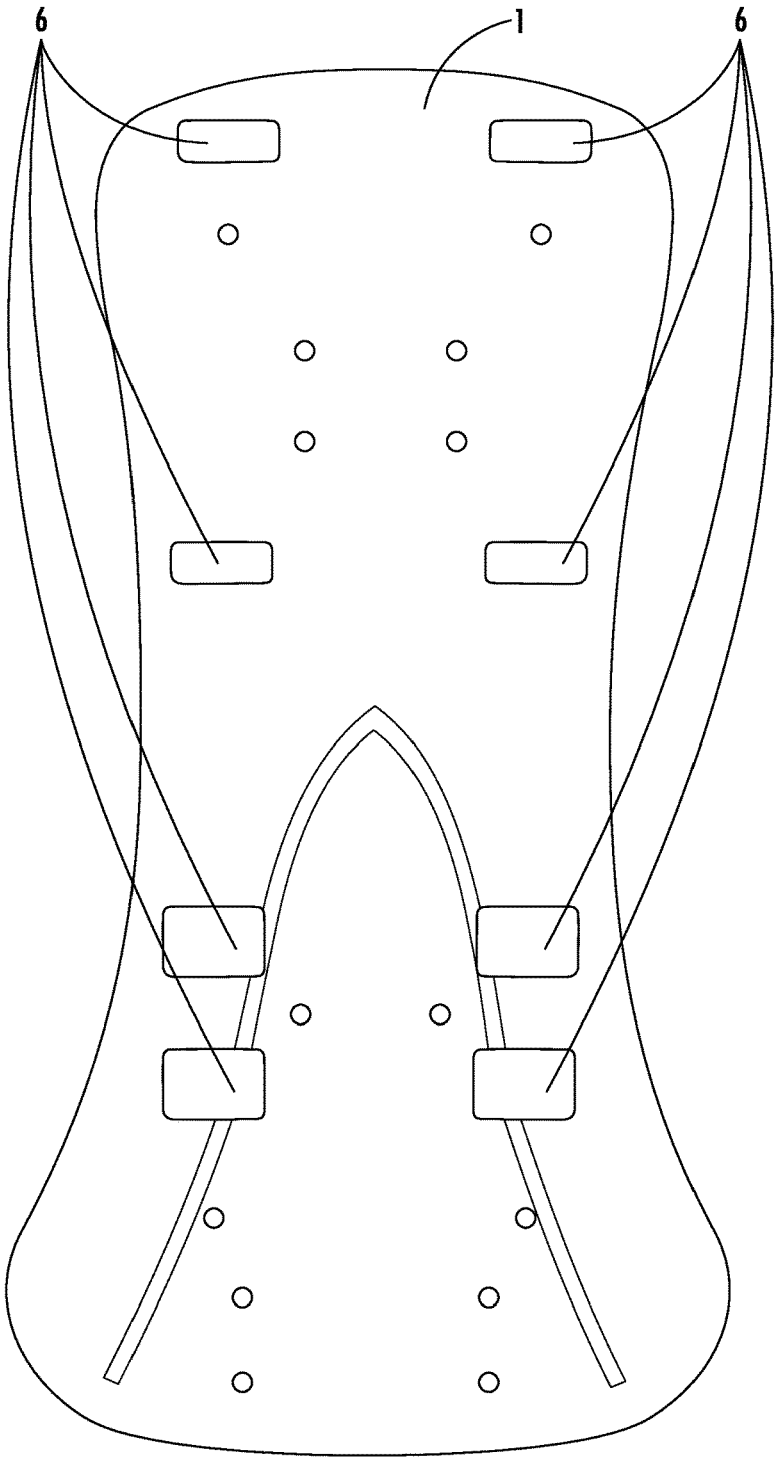
FIG. 3 is a rear view of a back plate which forms part of the assembly of FIG. 1.

Referring now to both FIG. 2 and FIG. 3, the back plate 1 has apertures 6 formed therein. The MOLLE straps 2 may be weaved through the apertures 6 in order to fasten the back plate 1 to the jacket 3. Each MOLLE strap 2 may be secured in place by a buckle 7 to facilitate quick attachment and removal of the back plate 1 from the jacket 3 if required or desired.

With reference now back to FIGS. 1 and 2, the back plate 1 also has a tank strap 10 that is mounted towards the top of the back plate 1. In addition, the back plate 1 has an air supply valve mount 11 that is provided towards the bottom of the back plate 1. The tank strap 10 and/or the valve mount 11 may have a quick release mechanism or operation. In an embodiment, the valve mount 11 includes a bayonet type coupling configured to interface with an air supply valve 12 to attach the air supply valve 12 to the back plate 1. The bayonet type coupling may require a 90 degree turn of the air supply valve 12 in one direction relative to the back plate 1 to secure the air supply valve 12 to the back plate 1, and a 90 degree turn in the opposite direction to release the air supply valve 12 from the plate 1. The details of the bayonet type coupling are known in the art and will not be described in further detail herein.

The valve mount 11 secures the air supply valve 12 to the back plate 1. The valve mount 11 is configured to be located in a position on the back plate 1 that allows the air supply valve 12 coupled thereto to automatically locate or align with an air valve or outlet disposed on the top of an air tank (not shown) that is mounted onto the back plate 1 and secured in place with the tank strap 10. The air supply valve 12 may include a fastener for coupling or sealing the air supply valve 12 to the air outlet of the air tank.

The back plate 1 may also include pipe retainers 15. The pipe retainers 15 are configured to route supply tubes or pipes from the air supply valve 12 to one or more designated operational positions, such as positions that are accessible to the user while the user is wearing the jacket.

Figure 4:
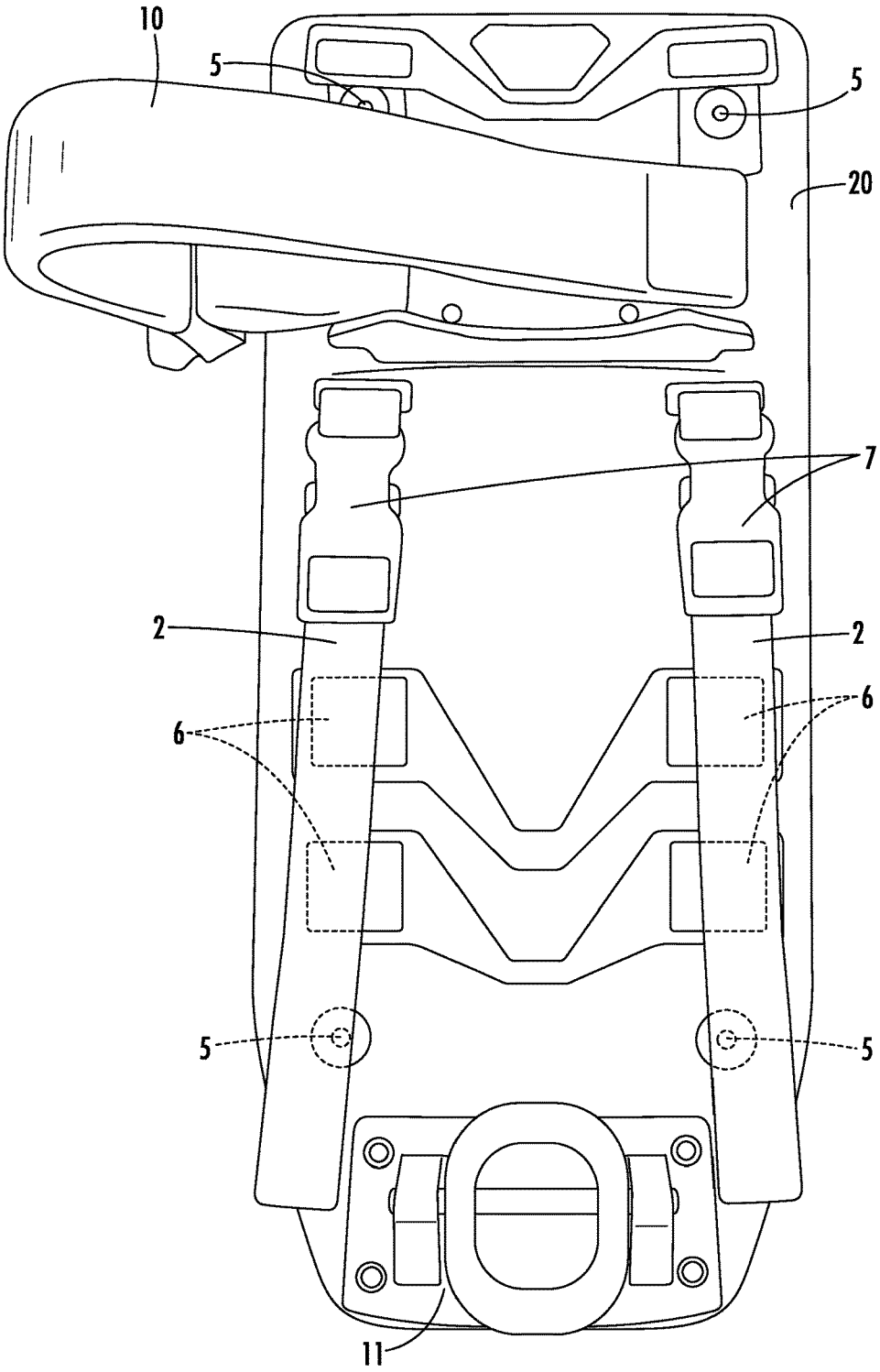
FIG. 4 is a rear view of a mounting assembly according to another embodiment.
Figure 5:
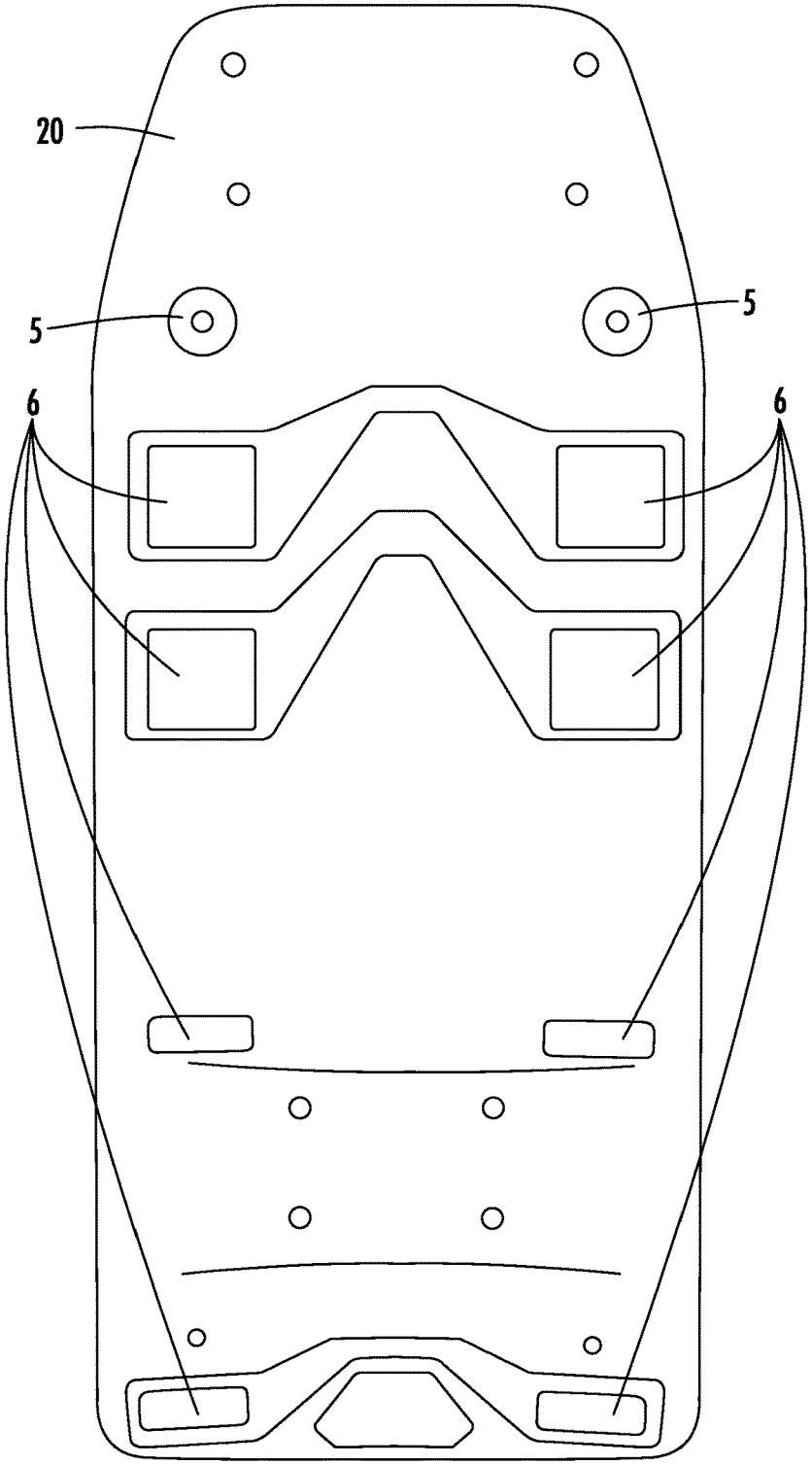
FIG. 5 is a rear view of a back plate which forms part of the mounting assembly of FIG. 4.

FIG. 4 is a rear view of a mounting assembly according to another embodiment. FIG. 5 is a rear view of a back plate which forms part of the mounting assembly of FIG. 4. In the embodiment of the mounting assembly shown in FIGS. 4 and 5, like features are identified using the same reference numerals as the embodiment of the mounting assembly shown in FIGS. 1-3. The mounting assembly in FIGS. 4 and 5 includes a back plate 20 that is configured in a similar manner to that of the back plate 1 shown in FIGS. 1-3 except that the shape has been changed to provide potentially a more comfortable fit for the wearer. The back plate 20 has apertures 6 arranged in two columns, with one column extending down each side edge of the back plate 20. MOLLE straps 2 may be woven through the apertures 6 (or through the columns of apertures 6) in order to secure the back plate 20 to webbing straps of a carry jacket. Each MOLLE strap 2 may be secured to the back plate 20 at top and bottom ends by press studs 5. The press studs 5 enable quick release of the MOLLE straps 2, such as when it is required to dump the back plate 20 and any apparatus mounted thereon.

The back plate 1, 20 (according to either embodiment) is configured to be used with a jacket having horizontally extending webbing straps distributed vertically down the jacket. Each webbing strap may have portions that are not connected to the jacket, defining slots or gaps, which enables vertical straps to be threaded between the webbing straps and the jacket. The back plate 1, 20 may be connected to the jacket by: threading a first connecting end of a MOLLE strap 2 to the top press stud 5 on the respective plate 1, 20; passing the MOLLE strap 2 through one aperture 6 of one of the columns on the respective plate 1, 20: feeding the MOLLE strap 2 between one of the webbing straps and the jacket; feeding the MOLLE strap 2 up through the next aperture 6 in the column and back down the subsequent aperture 6 in the column; feeding the MOLLE strap 2 between another of the webbing straps and the jacket; and continuing on until the MOLLE strap 2 has been fed through the last aperture 6. Once the MOLLE strap 2 has been fed through the last aperture 6, a second end is fastened to a lower press stud 5. The process is repeated with a second MOLLE strap 2 being fed through the apertures 6 of the second column. The back plates 1, 20 thus may be secured to the jacket using the MOLLE straps 2.

In an embodiment, after securing the back plate 1, 20 to the jacket, an air supply valve 12 (shown in FIG. 2) may be secured to the valve mount 11 by engaging the coupling parts and turning the supply valve 12 through 90 degrees to lock the supply valve 12 to the valve mount 11. Supply pipes, configured to convey air to and/or from the user, may be fed through pipe retainers 15 to hold the supply pipes in place. Finally, an air tank may be inserted through the tank strap 10 such that an air outlet of the air tank engages the supply valve 12. The tank strap 10 is subsequently tightened to lock or secure the air tank to the back plate 1, 20. Optionally, each of these steps may be performed by the user before donning the jacket or may be performed by a helper while the user is wearing the jacket.

In an embodiment, the user has at least three options for removing equipment during use. First, the air tank may be removed by disconnecting the air outlet from the air supply valve 12 (shown in FIG. 2) and then releasing the tank strap 10. The air tank may then be lifted off of the back plate 1, 20, leaving the back plate 1, 20, with the supply valve 12 coupled thereto, in place attached to the jacket. This option may be performed by the wearer on his or her own after first removing the jacket or may be performed with assistance from another person while the jacket is still being worn by the wearer.

A second option is to remove both the air tank and the air supply valve 12 (shown in FIG. 2) together. The supply valve 12 is released by rotating the supply valve 12 *a* 90 degree turn relative to the valve mount 11 to disconnect it from the valve mount 11. Then, the tank strap 10 may be released to disconnect the air tank from the back plate 1, 20. The air tank with the supply valve 12 still attached may then be removed from the back plate 1, 20, leaving the plate 1, 20 attached to the jacket. Again, this second option may be performed by the wearer on his or her own by first removing the jacket or with assistance of another person while the jacket is still being worn by the wearer. This second option may be quicker than the first option and/or may relieve more weight than the first option.

In an emergency situation, a third option for the user is to dump or remove the back plate 1, 20 from the jacket while the air tank and air supply valve 12 (shown in FIG. 2) are both still attached to the back plate 1, 20 so as to completely remove all of the equipment from the jacket. This option may be performed by the wearer without removing the jacket and without third party assistance by simply reaching behind and releasing the press studs 5 at either the top or the bottom of each MOLLE strap 2. Once the MOLLE straps 2 are released, the weight of the air tank causes the MOLLE straps 2 to pull out of the apertures 6 and webbing straps, dropping the back plate 1, 20 off of the jacket.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A mounting assembly for a self-contained breathing apparatus (SCBA) comprising:

a back plate including an inner side and an opposite outer side and extending between a top and a bottom, the back plate defining a plurality of apertures extending therethrough between the inner side and the outer side, the apertures arranged in a first column and a second column, the apertures in the first and second columns being sized and spaced to receive corresponding first and second mounting straps woven therethrough such that the first mounting strap is woven through the first column and the second mounting strap is woven through the second column, the first and second mounting straps configured to extend around webbing straps of a carrying jacket of a user to fasten the back plate to the carrying jacket, the inner side of the back plate facing the carrying jacket when the back plate is fastened to the carrying jacket, the back plate further including at least a first press stud associated with the first column and a second press stud associated with the second column, the first and second press studs each configured to engage an end of the respective first and second mounting straps to releasably secure the first and second mounting straps to the back plate;

a tank securing strap fastened to the back plate and extending from the outer side of the back plate, the tank securing strap configured to engage a supply tank to securely and releasably fasten the supply tank to the back plate; and a valve retaining mount disposed on the back plate along the outer side, the valve retaining mount configured to releasably secure an air supply valve to the back plate for engagement with the supply tank.

2. The mounting assembly of claim 1, wherein the first and second press studs are disposed on the outer side of the back plate.

3. The mounting assembly of claim 1, wherein the back plate has a unitary, one-piece body.

4. The mounting assembly of claim 1, wherein the back plate does not couple to shoulder straps.

5. The mounting assembly of claim 1, wherein the tank securing strap is fastened to the back plate proximate to the top of the back plate and the valve retaining mount is disposed proximate to the bottom of the back plate.

6. The mounting assembly of claim 1, wherein the first and second columns extend parallel to a vertical axis extending between the top and the bottom of the back plate.

7. The mounting assembly of claim 1, wherein the first press stud is located on the back plate in alignment with the first column and the second press stud is located on the back plate in alignment with the second column.

8. The mounting assembly of claim 1, wherein the first press stud is disposed between two adjacent apertures in the first column and the second press stud is disposed between two adjacent apertures in the second column.

9. The mounting assembly of claim 1, wherein the first press stud is disposed above the tank securing strap and below a top aperture in the first column, the second press stud being disposed above the tank securing strap and below a top aperture in the second column, the top apertures being most proximate to the top of the back plate.

10. The mounting assembly of claim 1, wherein the first press stud aligns with the first column and the second press stud aligns with the second column, the first and second press studs located proximate to the top of the back plate, the back plate further including a third press stud aligned with the first column proximate to the bottom of the back plate and a fourth press stud aligned with the second column proximate to the bottom of the back plate.

11. The mounting assembly of claim 1, wherein the apertures in the first and second columns are elongated laterally such that a lateral width of each aperture is greater than a vertical height of the aperture.

12. A mounting assembly for a self-contained breathing apparatus (SCBA) comprising:

a back plate including an inner side and an opposite outer side and extending between a top and a bottom, the back plate defining a plurality of apertures extending therethrough between the inner side and the outer side, the apertures arranged in a first column and a second column, the back plate further including a first press stud associated with the first column and a second press stud associated with the second column;

first and second mounting straps, the first mounting strap being woven through the apertures in the first column, the second mounting strap being woven through the apertures in the second column, the first and second mounting straps being woven through the respective first and second columns such that each of the first and second mounting straps alternates between extending along the inner side of the back plate and extending along the outer side of the back plate, portions of the first and second mounting straps extending along the inner side of the back plate configured to extend around webbing straps of a carrying jacket of a user to fasten the back plate to the carrying jacket, an end of the first mounting strap coupling to the first press stud to releasably secure the first mounting strap to the back plate, an end of the second mounting strap coupling to the second press stud to releasably secure the second mounting strap to the back plate;

a tank securing strap fastened to the back plate and extending from the outer side of the back plate, the tank securing strap configured to engage a supply tank to securely and releasably fasten the supply tank to the back plate; and a valve retaining mount disposed on the back plate along the outer side, the valve retaining mount configured to releasably secure an air supply valve to the back plate for engagement with the supply tank.

13. The mounting assembly of claim 12, wherein the first and second mounting straps each include a buckle for releasably coupling two portions of each respective mounting strap to one another.

14. The mounting assembly of claim 12, wherein the apertures in the first and second columns are elongated laterally such that a lateral width of each aperture is greater than a vertical height of the aperture.

15. The mounting assembly of claim 14, wherein the first and second mounting straps each have opposite broad sides that extend between opposite edge sides, wherein lateral widths of the first and second mounting straps between the respective edge sides are greater than thicknesses of the first and second mounting straps between the respective broad sides, the lateral widths of the apertures being greater than the lateral widths of the first and second mounting straps.

16. The mounting assembly of claim 12, wherein the first press stud is disposed proximate to the top of the back plate, the end of the first mounting strap coupled to the first press stud is a top end of the first mounting strap, the back plate further including a third press stud disposed proximate to the bottom of the back plate and associated with the first column, the third press stud releasably coupling to a bottom end of the first mounting strap.

17. The mounting assembly of claim 16, wherein the second press stud is disposed proximate to the top of the back plate and the end of the second mounting strap coupled to the second press stud is a top end of the second mounting strap, the back plate further including a fourth press stud disposed proximate to the bottom of the back plate and associated with the second column, the fourth press stud configured to releasably couple to a bottom end of the second mounting strap, the first and third press studs aligning with the first column, the second and fourth press studs aligning with the second column of aperture.

18. The mounting assembly of claim 17, wherein the first, second, third, and fourth press studs are disposed on the outer side of the back plate.

19. The mounting assembly of claim 12, wherein the first press stud is disposed between a top aperture and an adjacent aperture in the first column and the second press stud is disposed between a top aperture and an adjacent aperture in the second column, wherein an end portion of the first mounting strap extends upward from the first press stud through the top aperture in the first column and an end portion of the second mounting strap extends upward from the second press stud through the top aperture in the second column.

20. The mounting assembly of claim 12, wherein the first and second mounting straps woven through the respective first and second columns extend perpendicular to the webbing straps of the carrying jacket.

* * * * *